US007143826B2

(12) United States Patent
Nguyen et al.

(10) Patent No.: US 7,143,826 B2
(45) Date of Patent: Dec. 5, 2006

(54) METHOD FOR DETERMINING SAND FREE PRODUCTION RATE AND SIMULTANEOUSLY COMPLETING A BOREHOLE

(75) Inventors: Philip D. Nguyen, Duncan, OK (US); Michael W. Sanders, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 636 days.

(21) Appl. No.: 10/241,103

(22) Filed: Sep. 11, 2002

(65) Prior Publication Data

US 2004/0045707 A1 Mar. 11, 2004

(51) Int. Cl.
*E21B 47/06* (2006.01)
*E21B 43/00* (2006.01)
*E21B 47/10* (2006.01)

(52) U.S. Cl. ..... 166/250.07; 166/370; 175/50; 73/152.38; 73/152.47

(58) Field of Classification Search ..... 166/250.01, 166/250.02, 250.05, 250.07, 250.1, 369, 166/370; 175/40, 50; 73/152.01, 152.18, 73/152.19, 152.29, 152.37, 152.38, 152.42
See application file for complete search history.

(56) References Cited

U.S. PATENT DOCUMENTS 2,805,720 A * 9/1957 Wiegand ..... 166/294
3,854,323 A * 12/1974 Heam et al. ..... 73/61.75
4,681,163 A * 7/1987 Guidry et al. ..... 166/278
4,745,802 A 5/1988 Purfurst ..... 73/155
4,926,942 A * 5/1990 Profrock, Jr. ..... 166/250.15
5,101,900 A * 4/1992 Dees ..... 166/288
5,103,428 A * 4/1992 Yale et al. ..... 367/27
5,113,941 A * 5/1992 Donovan ..... 166/250.01
5,233,866 A 8/1993 Desbrandes ..... 73/155
5,360,066 A * 11/1994 Venditto et al. ..... 166/250.1
5,372,200 A * 12/1994 Merrill, Jr. ..... 166/369
5,386,875 A * 2/1995 Venditto et al. ..... 166/308.1
5,497,658 A * 3/1996 Fletcher et al. ..... 73/152.18
5,829,520 A 11/1998 Johnson ..... 166/250.01
6,152,218 A * 11/2000 Safargar ..... 166/105.1
6,289,991 B1 9/2001 French ..... 166/382
6,325,146 B1 * 12/2001 Ringgenberg et al. . 166/250.17
6,412,565 B1 * 7/2002 Castano-Mears ..... 166/381
6,431,278 B1 * 8/2002 Guinot et al. ..... 166/252.5
6,446,719 B1 * 9/2002 Ringgenberg et al. . 166/250.12
6,510,896 B1 * 1/2003 Bode et al. ..... 166/276

OTHER PUBLICATIONS

R.G. Wan and J. Wang ,"Modelling Sand Production Within a Continuum Mechanics Framework," submitted to Petroleum Society's Canadian International Conference, Calgary, Alberta, 13 pp., (Jun. 4-8, 2000).
Website: http://www.pttc.org/soluctions/214.htm, Publication entitled "Controlling San Production," 5 pp, Petroleum Technology Transfer Council Connections, Houston, Tx (1999).

* cited by examiner

*Primary Examiner*—Jennifer H. Gay
(74) *Attorney, Agent, or Firm*—Robert A. Kent; McAfee & Taft

(57) ABSTRACT

The current invention provides methods for determining the sand production rate from unconsolidated and poorly consolidated subterranean formations under varying drawdown pressures. The current invention also allows for immediate production of fluid from the subterranean formation upon determination of the sand production rate. Additionally, the current invention provides a method for determining the detrimental sand production rate and/or the maximum sand free production rate for a subterranean formation. Finally, the current invention is applicable in vertical, horizontal, deviated and multi-lateral boreholes.

33 Claims, 3 Drawing Sheets

METHOD FOR DETERMINING SAND FREE PRODUCTION RATE AND SIMULTANEOUSLY COMPLETING A BOREHOLE

BACKGROUND OF THE INVENTION

The present invention provides improvements in the production of hydrocarbons and other fluids from subterranean formations. More precisely, the present invention provides improved methods for completing a borehole while also reducing or precluding the production of sand with fluids produced from a subterranean formation.

Fluid producing wells are often completed in unconsolidated or poorly consolidated subterranean formations. These formations typically contain loose or incompetent sand capable of flowing into the borehole with the produced fluids. Production of sand with the desired fluids has the potential to rapidly erode metal tubulars and other production equipment. Additionally, production of a significant quantity of sand with the desired fluid may damage the formation resulting in impaired fluid production from that portion of the formation. Clearly, excess sand production has the potential to significantly increase the operational costs of a well.

Various techniques and devices have been developed by the oil and gas industry to minimize the production of sand and other fine particulate matter with the produced fluids. Common devices and methods such as gravel packs, frac-packing, near-wellbore consolidation with curable resins, and expandable screens provide adequate solutions to the sand production problem. However, each solution in turn presents new and typically costly problems. Therefore, the industry continues to seek simple cost effective procedures for completing fluid producing wells while minimizing or eliminating the production of sand.

SUMMARY OF THE INVENTION

The current invention provides a method for determining the sand production rate of a subterranean formation under different drawdown pressures. The method extends a borehole from the surface into a subterranean formation. The borehole is completed except for a terminal portion extending about 2 to about 200 feet. Following isolation of the uncompleted terminal portion, fluid is produced therefrom under varying drawdown pressures while monitoring the production of sand with the fluid. The sand production rate is determined for various drawdown pressures.

The current invention also provides a method for completing a borehole penetrating a subterranean formation. The improved method reduces or preferably precludes the detrimental production of sand from the subterranean formation. Using methods known to those skilled in the art, the improved method extends a borehole from the surface into at least a portion of the subterranean formation. The borehole is completed, preferably with a casing, except for the terminal portion thereof. After the casing has been secured, preferably by cementing in place, the uncompleted portion of the borehole is isolated from the completed portion. Fluid is then produced from the uncompleted portion of the borehole under increasing drawdown pressures while monitoring sand production. Using data obtained during fluid production, the detrimental sand production rate is determined and the preferred production rate for the borehole established. Fluid is then produced from the completed portion of the borehole at a production rate less than the rate corresponding to the detrimental sand production rate.

In another embodiment, the current invention provides a method for determining the maximum sand free production rate of a subterranean formation. The method first extends a borehole into a subterranean formation using techniques known to those skilled in the art. Preferably, the borehole is completed with a cemented casing except for the terminal portion which remains uncompleted. The uncompleted region is isolated and fluid is produced from the uncompleted region. Fluid production from the uncompleted region takes place under increasing drawdown pressures. During fluid production, sand production is monitored for each drawdown pressure. Thereafter, the maximum sand free production rate is determined based on these observations.

In yet another embodiment, the current invention provides a method for completing and producing fluid from lateral boreholes branching from a primary borehole. In this embodiment, at least one lateral borehole branches off from the primary borehole. Typically, lateral boreholes are completed with only stand-alone well screens prior to initiating production. However, to determine the appropriate production rate necessary to avoid detrimental sand production, at least a portion of at least one lateral borehole remains uncompleted. Optionally, at least one entire lateral borehole remains uncompleted. Fluid is produced from the uncompleted region under increasing drawdown pressures while monitoring sand production. Using data obtained during fluid production, sand production rates are determined for various drawdown pressures and the preferred drawdown rate established for the formation. Fluid is then produced from the lateral boreholes at a rate determined to be less than the detrimental sand production rate. If the primary borehole penetrates several producing formations, then the drawdown test will preferably be repeated for each grouping of lateral boreholes in each producing formation.

DETAILED DISCLOSURE OF THE INVENTION

The current invention provides a method for determining the sand production rate of an unconsolidated or poorly consolidated subterranean formation under varying drawdown pressures. The current invention also provides an improved method for completing a borehole while reducing or precluding the detrimental production of sand with fluid produced from unconsolidated or poorly consolidated subterranean formations. In another embodiment, the current invention provides a method for determining the sand free production rate for an unconsolidated or poor consolidated formation. Finally, with only minimal modification, the current invention can be adapted for use in a borehole having a plurality of lateral boreholes.

For the purposes of this disclosure, the "detrimental sand production rate" is defined as that rate of fluid production resulting in sand production, for a given particle size range, which will erode well equipment necessitating replacement prior to the normal lifespan of the equipment. However, production rates less than the detrimental sand production rate will not necessarily preclude all erosion as well equipment is necessarily designed to withstand a certain degree of erosion during a normal lifespan. In contrast to the detrimental sand production rate, the "maximum sand free production rate" for a given range of particle sizes is that rate which will not cause any damage to the production hardware. However, as is known to those skilled in the art, traces of sand in the production pipe will not necessarily result in damage to the pipe or associated hardware. Therefore, for the purposes of this disclosure, the maximum sand free production rate may contain some quantity of sand provided that the amount does not damage production hardware.

The methods of the current invention provide the well operator with information concerning sand production rates under varying drawdown pressures. Using this knowledge, the operator will be able to maximize fluid production without damaging the production hardware or the formation. Additionally, knowledge of sand production rates, particle size and approximate production equipment erosion rates, will allow the operator to schedule maintenance of the production equipment prior to the failure of a given component. Accordingly, the current invention provides a method for determining the sand production rate of an unconsolidated or poorly consolidated formation 10 under various drawdown pressures.

Figure 1:
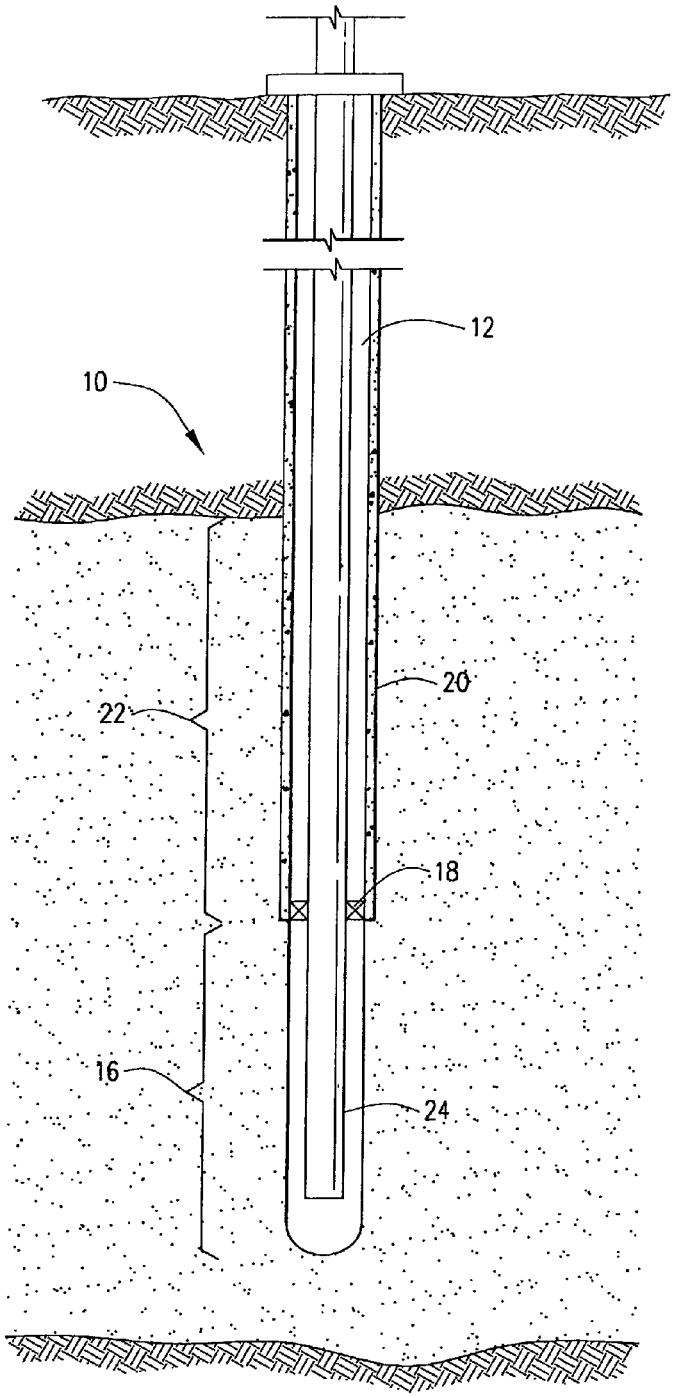
FIG. 1 depicts a downhole environment suitable for practicing the methods of the current invention including a subterranean formation penetrated by a borehole.
Figure 2:
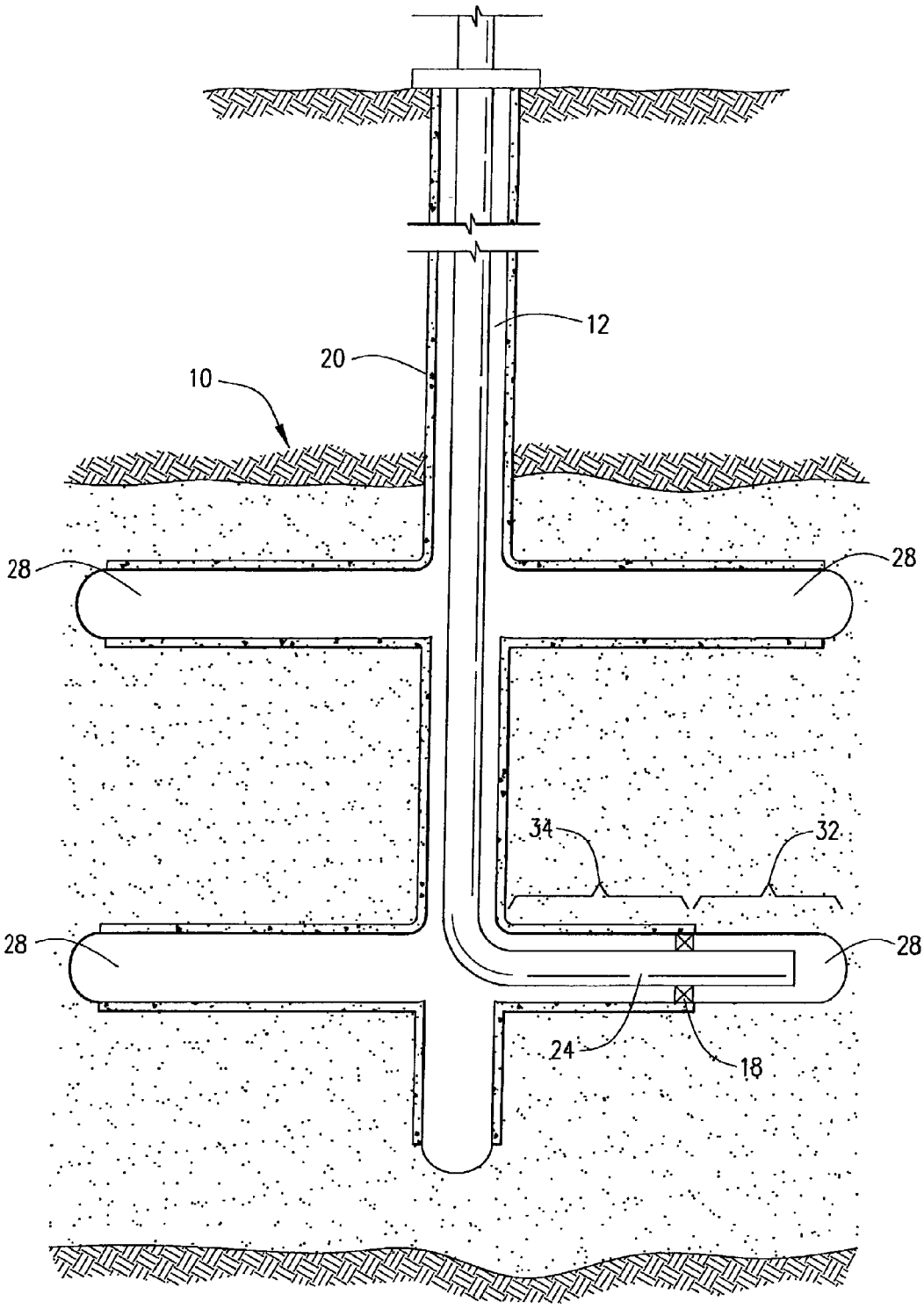
FIG. 2 depicts another downhole environment suitable for practicing the methods of the current invention including a subterranean formation penetrated by lateral boreholes branching from a primary borehole.
Figure 3:
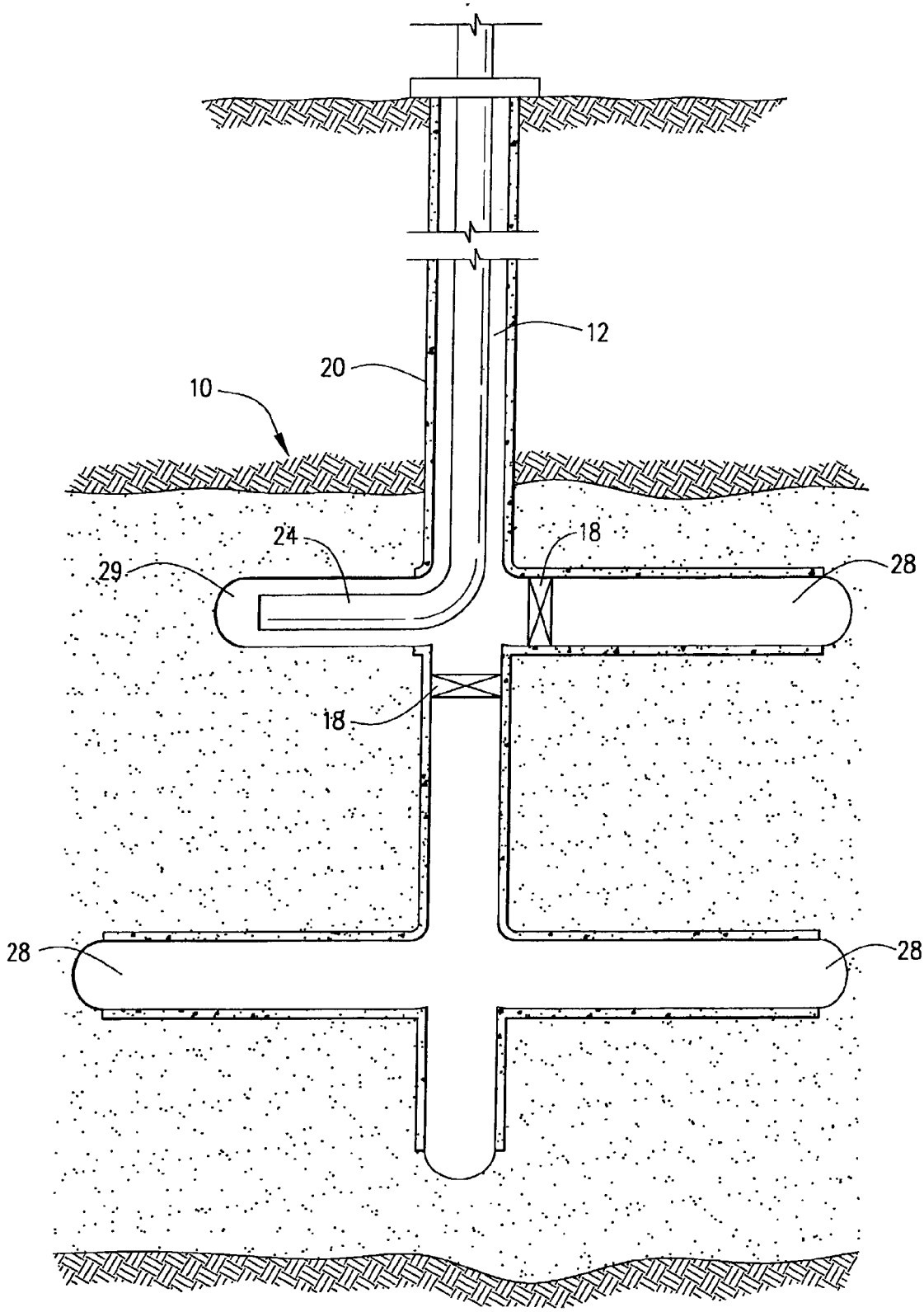
FIG. 3 depicts another downhole environment suitable for practicing the methods of the current invention including a subterranean formation penetrated by lateral boreholes and a test borehole branching from a primary borehole.

The various embodiments of the current invention will be described in detail with reference to FIGS. 1–3. The drawings depict hardware typically used in the current invention; however, hardware suitable for practicing the method of the current invention may vary depending upon the particular downhole environment encountered. As shown in FIG. 1, a substantial portion of borehole 12 penetrating formation 10 is completed; however, an uncompleted region 16 remains at the terminal portion thereof. Uncompleted region 16 provides a test area for determining sand production under various drawdown pressures. FIG. 2 depicts a similar arrangement for lateral boreholes 28 where the primary length of borehole 28 is completed with a portion at the end of one borehole 28 remaining uncompleted. Finally, FIG. 3 depicts formation 10 penetrated by lateral boreholes 28 and a test borehole 29 all branching from primary borehole 12. Test borehole 29 is shown uncompleted.

Turning first to FIG. 1, the method of the current invention will be described as applied in a primary borehole 12. As shown in FIG. 1, borehole 12 extends from the surface through the earth penetrating at least one producing formation 10. Preferably, borehole 12 is completed except for a terminal portion thereof. The uncompleted region 16 will serve as a test site to determine the sand production rate under varying drawdown pressures. As a general guideline, uncompleted region 16 will be from about 2 feet to about 200 feet in length. Normally a distance of about 5 to 25 feet will provide the data necessary in the method of the current invention. However, the length of uncompleted region 16 is not critical to the current invention. Rather, the length must be sufficient to provide a representative measurement of the sand production rate for a given formation 10. Typically, the operator will determine the preferred length of uncompleted region 16 based on the expected sand production derived from data obtained during drilling of borehole 12.

If, as shown in FIG. 1, primary borehole 12 is completed with a perforated casing 20, then preferably a packer 18 will be fitted to the end of casing 20. Although packer 18 is the preferred device in the current invention, any device capable of isolating and allowing production of fluids from uncompleted region 16 will suffice. In this instance, packer 18 allows for the selective isolation of uncompleted region 16 from completed region 22. Casing 20 may be perforated prior to installation or perforated downhole after being secured in borehole 12. Additional components commonly used during performance of the improved method will be described below.

In systems where casing 20 is not perforated prior to performing the drawdown test, packer 18 and flow-through tubing 24 may be omitted. Under these conditions, the drawdown test will be performed as described below. However, the drawdown pressure will be applied to region 16 through casing 20 instead of flow-through tubing 24.

Following positioning of packer 18, flow-through tubing 24 is run downhole, passing through packer 18, into uncompleted region 16. Once flow-through tubing 24 is in position, packer 18 is inflated by conventional methods to isolate uncompleted region 16 from completed region 22. Transmittal of drawdown pressure through tubing 24 initiates production of fluid and sand from uncompleted region 16.

Following isolation of uncompleted region 16, drawdown pressure is applied to initiate fluid and sand production. The drawdown test continually increases the drawdown pressure applied to uncompleted region 16. Typically, drawdown pressure gradually increases until sand production is clearly excessive. During the test, sand production rates are measured at various drawdown pressures and production rates. Provided that formation 10 is generally uniform, sand production at a given pressure should be consistent throughout formation 10 including completed region 22. However, if formation 10 is known to have varying degrees of consolidation, then the operator may use the data obtained by the test to plot predicted sand production for the various areas of formation 10. In addition to determining the sand production rate, the current method optionally determines the size of the sand particles produced at each drawdown pressure. Knowledge of the particle size will assist the operator in determining the type of filtering apparatus necessary, if any, when producing fluid from completed region 22.

The drawdown test of the current invention also provides a method for completing borehole 12 and reducing or precluding the production of sand from formation 10. Because the drawdown test may be performed within a completed production borehole 12, fluid production from formation 10 may be initiated following removal of unnecessary hardware such as flow-through tubing 24 and completion or isolation of uncompleted region 16. Preferably, the production rate for borehole 12 will be less than the rate corresponding to the detrimental sand production rate. Thus, the current invention provides a method for completing a borehole and producing fluid therefrom at a rate which will prolong the life of the production hardware.

If casing 20 was not perforated prior to installation, then standard perforation and subsequent borehole completion steps will be performed prior to producing fluid from completed region 22. For example, casing 20 may be perforated, followed by installation of filtration media (not shown) such as gravel packs or expandable well screens. In either case, the filtration media should be chosen based on the predicted sand production rate and predicted particle size for a given drawdown pressure.

Preferably prior to initiating production from completed region 22, uncompleted region 16 is either completed in a manner to permit continued production or isolated from completed region 22. If uncompleted region 16 remains suitable for production, then conventional completion techniques may be used to prepare the area for production. Preferably, a gravel pack (not shown) is installed in uncompleted region 16. Other filtering mediums, including but not limited to expandable screens, permeable cement, near-wellbore consolidation with curable resins, and other well known devices and techniques will also provide the filtering necessary to permit production from uncompleted region 16. However, if uncompleted region 16 is no longer suitable for production following the drawdown test, then packer 18 may be used to completely isolate uncompleted region 16 from completed region 22. Other methods for isolating uncompleted region 16 from completed region 22 will be apparent to those skilled in the art. In general, uncompleted region 16 should be precluded from producing sand into borehole 12 once production of completed region 22 is initiated.

The method for determining the desired production rate of a formation has been described within the environment of a cased borehole. However, expandable well screens (not shown) may be substituted for casing 20. In this instance, the well screens may be optionally expanded and encased within a permeable media such as compressible foam, curable resin beds or permeable cement or other similar material known to those skilled in the art. Following completion of region 22 with well screens, an isolation packer (not shown) is installed to provide the means for isolating the test region. In this instance the test region corresponds to uncompleted region 16 depicted in FIG. 1. After insertion of flow-through tubing 24 through isolation packer (not shown) and expansion of the packer to isolate the test region, the method for determining the desired production rate of a formation is carried out as described above.

Turning now to FIGS. 2 and 3, the method of the current invention will be described as applied to lateral boreholes 28. Lateral boreholes 28 are commonly used to increase production from formation 10. Although typically smaller in diameter than primary borehole 12, lateral-boreholes 28 penetrating an unconsolidated or poorly consolidated formation 10 will also experience sand production. Therefore, the current invention also provides a method for completing and producing fluid from lateral boreholes 28. Additionally, the method of the current invention provides the operator with the ability to estimate the maximum sand free production rate and the detrimental production rate for lateral boreholes 28.

As shown in FIG. 2, a series of lateral boreholes 28 branch off of primary borehole 12. The method of performing the drawdown test and applying the results thereof discussed with respect to FIG. 1 apply equally well to the use of the drawdown test in lateral boreholes 28. Normally, the drawdown test will be performed on only one lateral borehole 28 per producing formation 10; however, if formation 10 has varying degrees of consolidation, then the operator may elect to test additional boreholes 28. The lateral borehole 28 to be tested will be completed over its primary length with the terminal portion 32 thereof remaining uncompleted. Uncompleted region 32 corresponds to uncompleted region 16 for the purposes of applying the drawdown test. As discussed above, borehole 28 may be completed either with casing 20 or expandable well screens (not shown), or any other completion method known in the art.

As shown in FIG. 3, when multiple lateral boreholes 28 penetrate formation 10, the drawdown test of the current invention may optionally be carried out in a test borehole 29. In general, test borehole 29 is an uncompleted lateral borehole 28. Typically, test borehole 29 will be shorter than multilateral boreholes 28 intended for production.

The use of test borehole 29 offers greater flexibility in the manner of completing the borehole. For example, following drilling of primary borehole 12, a single test borehole 29 can be drilled into formation 10 and tested according to the methods of the current invention. Following completion of the drawdown test, test borehole 29 is optionally sealed or completed with conventional methods, followed by drilling and completing conventional lateral boreholes 28.

Alternatively, all of the desired lateral boreholes 28, including test borehole 29, can be drilled prior to performing the drawdown tests. Production lateral boreholes 28 are optionally completed prior to testing borehole 29. In this embodiment, test borehole 29 must be isolated from production lateral boreholes 28 during testing. Isolation of test borehole 29 can be achieved in several different ways all of which are familiar to one skilled in the art. One preferred method for isolating borehole 29 is installation of an isolation packer, not shown, within borehole 29 and running tubing 24 through packer 18 into borehole 29. Alternatively, as shown in FIG. 3, packers 18 may be installed in primary borehole 12 and lateral borehole 28. Once test borehole 29 is isolated from production lateral boreholes 28 by any convenient arrangement, the drawdown test is carried out as described above.

Specifically, the drawdown test of the current invention provides a method for completing lateral boreholes 28 while reducing or precluding the production of sand from formation 10. In this embodiment, either a lateral borehole 28 or a test borehole 29 is extended into at least one subterranean formation 10. When using the drawdown test in lateral borehole 28, the preferred process initially completes borehole 28 using a perforated casing 20. Casing 20 is secured within borehole 28 by conventional means such as cementing; however, the terminal end of borehole 28 remains uncompleted. Uncompleted region 32 will serve as a test area for determining the sand production rate of formation 10 under various drawdown pressures. In contrast, when using test borehole 29 a casing is not needed within borehole 29 as the entire length of borehole 29 functions as the test zone equivalent of uncompleted regions 16 and 32. For this reason, test borehole 29 may be shorter in length than lateral borehole 28.

Performing a drawdown test within lateral borehole 28 having a perforated casing 20 positioned therein requires isolation of uncompleted region 32 from completed region 34. Therefore, preferably after casing 20 has been installed and cemented in place, a packer 18 is installed as a means for isolating uncompleted region 32 from completed region 34. Although a packer 18 is shown in this particular configuration, any means for isolating and producing fluid from uncompleted region 32 will suffice in the current invention. Subsequently, flow-through tubing 24 is run downhole, through packer 18 and into uncompleted region 32. Flow-through tubing 24 is connected to conventional production apparatus (not shown) located at the surface. Following positioning of flow-through tubing 24, packer 18 is inflated in order to isolate and allow production from uncompleted region 32. As noted above, packer 18 and tubing 24 may be omitted if casing 20 is not perforated prior to performing the drawdown test. However, lateral borehole 28 must be isolated from other lateral boreholes 28 during the test. The methods for isolating test borehole 29 from primary borehole 12 described herein will also serve to isolate lateral borehole 28 and will not be repeated.

When performing the drawdown test on test borehole 29, the process will vary depending on whether or not the operator drilled all of the lateral boreholes 28 prior to initiating the test. As noted above, the operator may elect to initially drill and test borehole 29 prior to drilling the remaining lateral boreholes 28. In this instance, hardware necessary to isolate test borehole 29 from lateral boreholes 28 may be omitted. At most, a packer 18 may be required at a position within primary borehole 12 below test borehole 29. Placement of packer 18 in this position allows for direct application of drawdown pressure within test borehole 29. Alternatively, an isolation packer or equivalent, not shown, and flow-through tubing 24 may be placed in test borehole 29 for the purposes of applying drawdown pressure directly within borehole 29. If the operator drills lateral boreholes 28 prior to performing the drawdown test on borehole 29, then placement of packers 18 and flow-through tubing 24 as depicted in FIG. 3 or an equivalent arrangement within test borehole 29 will be necessary.

The drawdown test will be performed in essentially the same manner in both lateral borehole 28 and test borehole 29 as was described above with regards to carrying out the test in uncompleted region 16 of borehole 12 depicted in FIG. 1. Accordingly, fluid is produced from uncompleted region 32 or test borehole 29 under increasing drawdown pressures. During fluid production, the sand production rate is determined for each drawdown pressure. Preferably, the sand particle size is also determined. Based on the sand production rate determined during the drawdown test, the fluid production rate corresponding to the detrimental sand production rate for the lateral boreholes 28 is determined.

If the drawdown test was performed in lateral borehole 28, then fluid production may be initiated upon completion of the test, removal of the associated equipment and completion or isolation of uncompleted region 32. If the drawdown test was performed in test borehole 29, initiation of fluid production will depend on the stage of completion of lateral boreholes 28. In either case, the production rate will be determined based on the results of the drawdown test as described above.

The method of the current invention also provides the means for determining the maximum sand free production rate of a subterranean formation. The method for determining the maximum sand free production rate can be carried out equally well in primary borehole 12, lateral borehole 28 or test borehole 29. For the sake of conciseness, the method will be described with relation to primary borehole 12. When determining the maximum sand free production rate of a formation, a borehole 12 is extended from the surface into the formation 10. Preferably, borehole 12 is completed by securing a casing 20 in the primary portion of borehole 12; however, the terminal portion of borehole 12 remains uncompleted. The uncompleted region 16 of borehole 12 is from about 2 to about 200 feet in length. Preferably, uncompleted region 16 is from about 5 to about 25 feet. Uncompleted region 16 serves as a test zone for determining the maximum sand free production rate for formation 10. Optionally, as noted above expandable well screens may be substituted for casing 20.

Uncompleted region 16 is isolated from completed region 22 by conventional means such as packer 18. Although packer 18 is shown in this particular configuration, any means for isolating and producing fluid from uncompleted region 16 will suffice in the current invention. Following isolation, fluid is produced from uncompleted region 16 through flow-through tubing 24 under increasing drawdown pressures. Drawdown pressures are continually increased until sand production sufficient to erode the production hardware is detected. Sand production sufficient to erode the production hardware will vary with the size and volume of sand produced. Therefore, the method of current invention preferably monitors both the sand production rate and the size of the produced particles. The maximum sand free production rate for the reservoir will be the maximum rate, which does not generate sand production sufficient to erode the production hardware. Therefore, the operator will need to only minimally reduce the drawdown pressure to achieve this target rate.

Other embodiments of the present invention will be apparent to those skilled in the art from a consideration of the accompanying drawings, this specification and/or practice of the invention disclosed herein. It is intended that the specification be considered as only exemplary, with the true scope and spirit of the invention being indicated by the following claims.

What is claimed is:

1. A method for determining the detrimental sand production rate of a subterranean formation comprising the steps of:

extending a borehole from the surface into at least a portion of a subterranean formation:

completing a portion of the borehole while leaving a portion uncompleted;

isolating the uncompleted portion of the borehole;

producing fluid from the isolated uncompleted portion of the borehole under varying drawdown pressures;

determining the sand production rate under various drawdown pressures; and, determining the fluid production rate corresponding to the detrimental sand production rate.

2. The method of claim 1, further comprising the steps of:

inserting flow-through tubing into the uncompleted portion of the borehole; and, producing fluid from the uncompleted portion of the borehole through the flow-through tubing.

3. The method of claim 1, wherein completed portion of the borehole is completed with a perforated casing and, further comprising the steps of:

installing a packer on the casing;

passing flow-through tubing through the packer into the isolated uncompleted portion of the borehole; and, subsequently producing fluid from the isolated uncompleted portion of the borehole.

4. The method of claim 1, wherein the uncompleted portion of the borehole is from about 2 to about 200 feet in length.

5. The method of claim 1, wherein the uncompleted portion of the borehole is from about 5 to about 25 feet in length.

6. The method of claim 1, further comprising the step of determining the particle size of the sand produced under varying drawdown pressures.

7. The method of claim 1, wherein the completed portion of the borehole is completed with expandable well screen and further comprising the steps of:

inserting a flow-through tubing through the completed portion of the borehole into the isolated uncompleted portion of the borehole; and, producing fluid from the isolated uncompleted portion of the borehole through the flow-through tubing.

8. The method of claim 7, further comprising the steps of:
installing a packer at the end of the completed portion of the borehole;
passing flow-through tubing through the packer into the uncompleted portion of the borehole; and,
subsequently producing fluid from the uncompleted portion of the borehole.

9. The method of claim 1, wherein the borehole is completed with a casing and wherein prior to producing fluid from the completed portion of the borehole, further comprising the steps of: perforating the casing; and,
placing and expanding an expandable screen adjacent to the resulting perforations.

10. The method of claim 1, wherein the fluid is produced from a lateral borehole.

11. A method for producing fluid from a subterranean formation comprising the steps of:
extending a borehole from the surface into at least a portion of a subterranean formation:
completing the borehole while leaving the terminal end thereof uncompleted;
isolating the uncompleted portion of the borehole from the completed portion;
producing fluid from the isolated uncompleted portion of the borehole under increasing drawdown pressures;
determining the fluid production rate corresponding to the detrimental sand production rate; and,
producing fluid from the completed portion of the borehole at a fluid production rate less than that corresponding to the detrimental sand production rate.

12. The method of claim 11, further comprising the steps of:
inserting flow-through tubing into the uncompleted portion of the borehole; and,
producing fluid from the uncompleted portion of the borehole through the flow-through tubing.

13. The method of claim 11, wherein the borehole is completed with a perforated casing and further comprising the steps of:
installing a packer at the end of the casing;
passing a flow-through tubing through the packer into the uncompleted portion of the borehole; and,
producing fluid from the uncompleted portion of the borehole.

14. The method of claim 11, wherein the borehole is completed with a casing cemented therein and wherein prior to producing fluid from the completed portion of the borehole, further comprising the steps of:
perforating the casing; and,
placing and expanding an expandable screen adjacent to the resulting perforations.

15. The method of claim 11, wherein the uncompleted portion of the borehole is from about 2 to about 200 feet in length.

16. The method of claim 11, wherein the uncompleted portion of the borehole is from about 5 to about 25 feet in length.

17. The method of claim 11, further comprising the step of determining the particle size of the sand produced under varying drawdown pressures.

18. The method of claim 11, further comprising the steps of:
completing the borehole with expandable well screen, except for the terminal portion thereof;
inserting flow-through tubing into the isolated uncompleted portion of the borehole; and,
producing fluid from the isolated uncompleted portion of the borehole through the flow-through tubing.

19. The method of claim 18, further comprising the steps of:
installing a packer at the terminal end of the completed portion of the borehole;
passing the flow-through tubing through the packer into the isolated uncompleted portion of the borehole; and,
subsequently producing fluid from the isolated uncompleted portion of the borehole.

20. The method of claim 11, wherein fluid is produced from a lateral borehole.

21. A method for determining the maximum sand free production rate of a subterranean formation comprising the steps of:
extending a borehole from the surface into at least a portion of a subterranean formation;
completing the borehole while leaving a portion of the terminal end thereof uncompleted;
isolating the uncompleted portion of the borehole from the completed portion;
producing fluid from the isolated uncompleted region under increasing drawdown pressures;
determining the particle size of sand produced under varying drawdown pressures; and,
determining the maximum sand free production rate.

22. The method of claim 21, further comprising the step of inserting flow-through tubing into the uncompleted portion of the borehole and producing fluid from the uncompleted portion of the borehole through the flow-through tubing.

23. The method of claim 21, further comprising the steps of:
installing a packer on the terminal end of the completed portion of the borehole;
passing flow-through tubing through the packer into the uncompleted portion of the borehole; and,
subsequently producing fluid from the uncompleted portion of the borehole.

24. The method of claim 21, wherein the uncompleted portion of the borehole is from about 2 to about 200 feet in length.

25. The method of claim 21, wherein the uncompleted portion of the borehole is from about 5 to about 25 feet in length.

26. The method of claim 21, wherein the method is performed in a lateral borehole extending from a primary borehole.

27. A method for producing fluid from a subterranean formation comprising the steps of:
extending a borehole from the surface into at least a portion of a subterranean formation;
the borehole having at least one lateral borehole extending therefrom;
at least a portion of at least one lateral borehole is uncompleted;
isolating the uncompleted portion of at least one lateral borehole;
producing fluid from the isolated uncompleted portion of the lateral borehole under increasing drawdown pressures;
determining the fluid production rate corresponding to the detrimental sand production rate; and,
producing fluid from the borehole and any other lateral boreholes at a rate less than the detrimental sand production rate.

28. The method of claim 27, wherein the entire length of the lateral borehole is uncompleted.

29. The method of claim 28, further comprising the steps of:

installing a packer within the lateral borehole;

passing a flow-through tubing through the packer into the lateral borehole; and, producing fluid from the lateral borehole through the flow-through tubing.

30. The method of claim 27, wherein a portion of the lateral borehole is completed and further comprising the steps of:

placing a packer in the completed portion of the lateral borehole;

inserting flow-through tubing through the packer and into the uncompleted portion of the lateral borehole; and, producing fluid from the uncompleted portion of the lateral borehole through the flow-through tubing.

31. The method of claim 30, wherein the uncompleted portion of the lateral borehole is from about 2 to about 200 feet.

32. The method of claim 30, wherein the uncompleted portion of the lateral borehole is from about 5 to about 25 feet.

33. The method of claim 27, further comprising the step of determining the particle size of the sand produced under varying drawdown pressures.

* * * * *